US010563849B2

(12) United States Patent
Vang et al.

(10) Patent No.: US 10,563,849 B2
(45) Date of Patent: Feb. 18, 2020

(54) DIMENSIONALLY ADJUSTABLE LUMINAIRE HOUSING

(71) Applicant: Hubbell Incorporated, Shelton, CT (US)

(72) Inventors: Seng Vang, Greer, SC (US); Martin Carl Werr, Easley, SC (US); David John Rector, Greenville, SC (US); Randy Kent Lewis, Greenville, SC (US); David Arthur Simoni, Piedmont, SC (US)

(73) Assignee: Hubbell Incorporated, Shelton, CT (US)

( * ) Notice: Subject to any disclaimer, the term of this patent is extended or adjusted under 35 U.S.C. 154(b) by 85 days.

(21) Appl. No.: 16/085,108

(22) PCT Filed: Dec. 30, 2015

(86) PCT No.: PCT/US2015/068116

§ 371 (c)(1),
(2) Date: Sep. 14, 2018

(87) PCT Pub. No.: WO2016/114931

PCT Pub. Date: Jul. 21, 2016

(65) Prior Publication Data

US 2019/0063729 A1 Feb. 28, 2019

Related U.S. Application Data

(60) Provisional application No. 62/104,387, filed on Jan. 16, 2015.

(51) Int. Cl.
*F21V 21/02* (2006.01)
*F21S 8/04* (2006.01)
(Continued)

(52) U.S. Cl.
CPC ..... *F21V 21/02* (2013.01); *F21S 8/04* (2013.01); *F21V 11/14* (2013.01); *F21V 17/107* (2013.01); *F21V 19/001* (2013.01)

(58) Field of Classification Search
CPC ..... F21V 21/02; F21V 19/001; F21V 17/107; F21V 11/14; F21V 15/01; F21V 17/18; F21S 8/04; F21Y 2115/10
See application file for complete search history.

(56) References Cited

U.S. PATENT DOCUMENTS 3,643,079 A 2/1972 Glickman
3,796,870 A * 3/1974 Pettyjohn, Jr. ..... F21S 8/02 362/223

(Continued)

OTHER PUBLICATIONS

PCT/US2015/068116 International Search Report and Written Opinion dated May 11, 2016.

*Primary Examiner* — Donald L Raleigh
(74) *Attorney, Agent, or Firm* — Michael Best & Friedrich, LLP

(57) ABSTRACT

A luminaire includes a wall assembly, a support, and a door. The wall assembly has a first side wall, a second side wall, a first end wall connected to the first and second side walls, and a second end wall connected to the first and second side walls. The support is connected to the wall assembly. The door includes a lens and is connected to the wall assembly. The door is moveable between an open position and a closed position. The side walls and end walls can be formed with various lengths and selectively connected together to form different sized wall assemblies.

19 Claims, 12 Drawing Sheets

(51) Int. Cl.

| | |
|---|---|
| ***F21V 11/14*** | (2006.01) |
| ***F21V 17/10*** | (2006.01) |
| ***F21V 19/00*** | (2006.01) |

(56) References Cited

U.S. PATENT DOCUMENTS

| | | | | |
|---|---|---|---|---|
| 3,810,085 | A | 5/1974 | Woloski | |
| 3,983,387 | A * | 9/1976 | Van Steenhoven ..... | F21S 8/086<br>362/375 |
| 7,234,832 | B2 | 6/2007 | Lippis | |
| 8,220,961 | B2 | 7/2012 | Belknap | |
| 2010/0027239 | A1 * | 2/2010 | Lovinger ..... | F21V 19/009<br>362/84 |
| 2013/0128558 | A1 | 5/2013 | Risley | |

* cited by examiner

SECTION B-B

SECTION C-C

SECTION B-B

SECTION C-C

SECTION E-E

SECTION A-A

DIMENSIONALLY ADJUSTABLE LUMINAIRE HOUSING

RELATED APPLICATION

This application is based on U.S. Provisional Application Ser. No. 62/104,387, filed Jan. 16, 2015, the disclosure of which is incorporated herein by reference in its entirety and to which priority is claimed.

FIELD

Various exemplary embodiments of the invention relate to luminaires, for example recessed luminaires.

BACKGROUND

Luminaires, or light fixtures, are used with electric light sources to provide aesthetic and functional housing in both interior and exterior applications. Various types of interior luminaires include overhead, ceiling, ceiling system, or suspended luminaires, which are designed to be positioned near, or suspended from, the ceiling.

SUMMARY

According to an exemplary embodiment, a luminaire housing includes a first set of side walls having a first length, a second set of side walls having a second length different than the first length, a first set of end walls having a third length, and a second set of end walls having a fourth length different than the third length. One of the first and second sets of side walls is connected to one of the first and second sets of end walls to form a wall assembly for a luminaire housing.

According to another exemplary embodiment, a luminaire housing includes a first a wall assembly having a first side wall, a second side wall, a first end wall connected to the first and second side walls, and a second end wall connected to the first and second side walls. A mounting plate is connected to the wall assembly so that the position of the mounting plate can be adjusted with respect to the wall assembly. A door having a lens is connected to the wall assembly and moveable between an open position and a closed position.

According to another exemplary embodiment, a luminaire housing includes a first side wall and a second sidewall connected to a first end wall and a second endwall. A top cover is connected to the first and second sidewalls and the first and second endwalls. A recess is positioned in the top cover to receive a control component for a light emitter.

BRIEF DESCRIPTION OF THE DRAWINGS

The aspects and features of various exemplary embodiments will be more apparent from the description of those exemplary embodiments taken with reference to the accompanying drawings, in which.

DETAILED DESCRIPTION OF EXEMPLARY EMBODIMENTS

Figure 1:
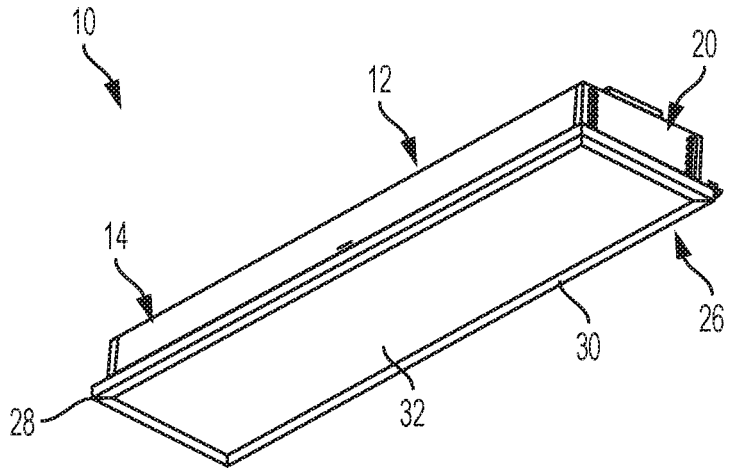
FIG. 1 is a bottom perspective view of an exemplary luminaire.
Figure 2:
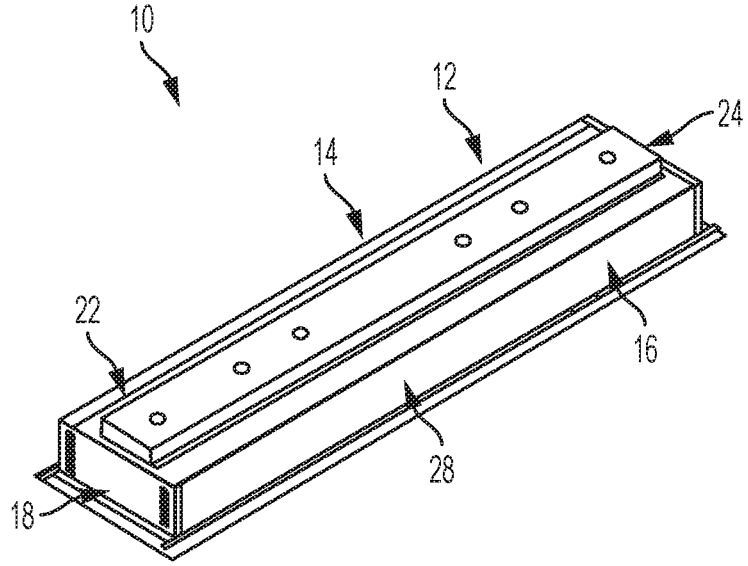
FIG. 2 is a top perspective view of the luminaire of FIG. 1.
Figure 3:
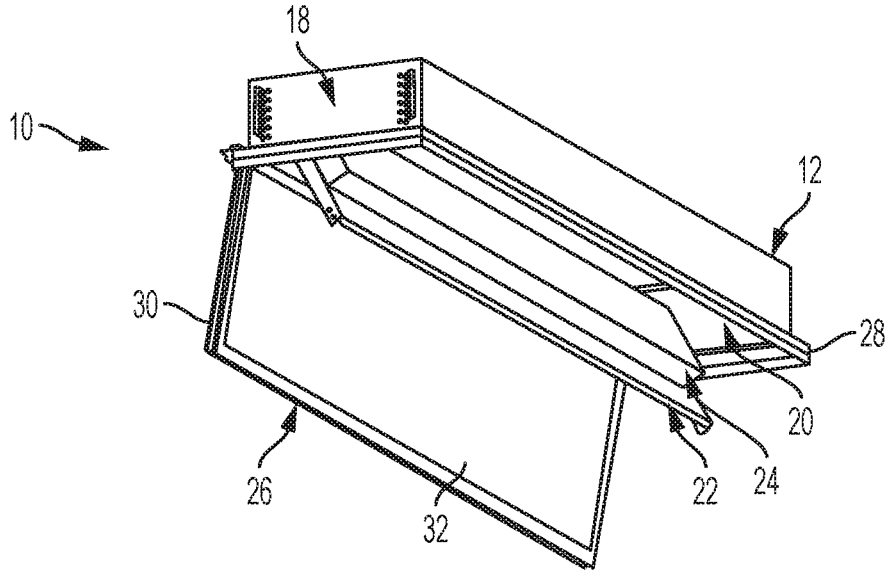
FIG. 3 is a bottom perspective view of the luminaire of FIG. 1 with the door open and the mounting plate partially removed.
Figure 4:
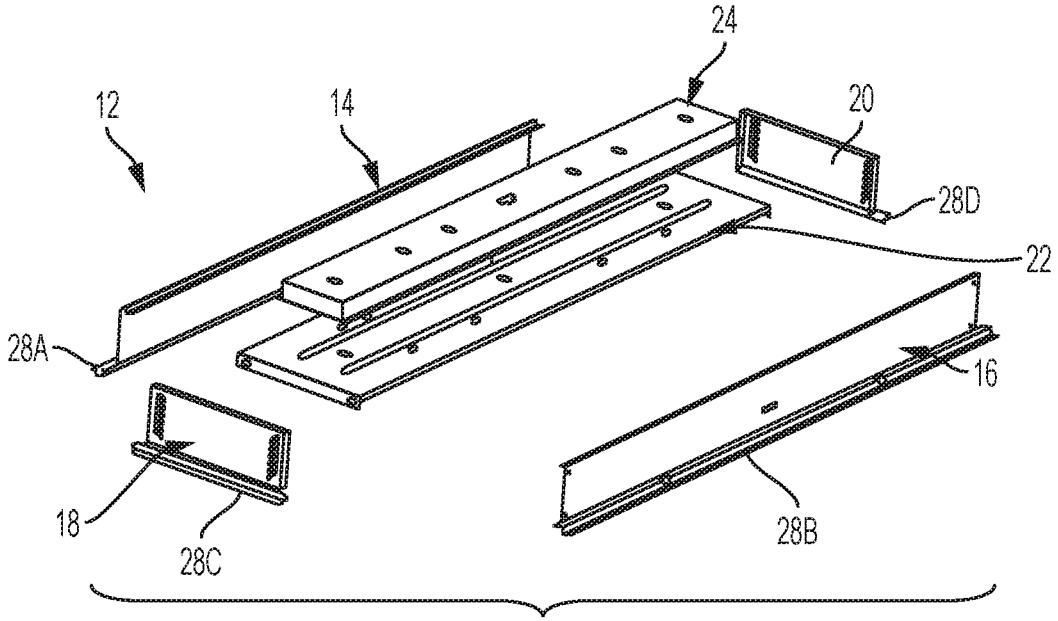
FIG. 4 is a top perspective, exploded, view of the of the luminaire of FIG. 1.
Figure 5:
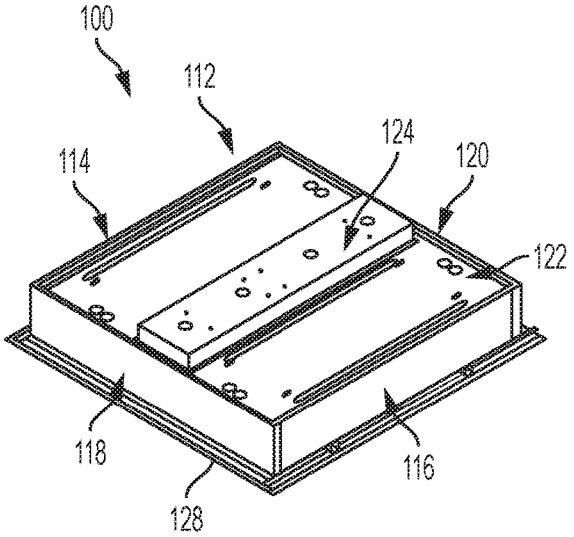
FIG. 5 is a top perspective view of another exemplary luminaire.
Figure 6:
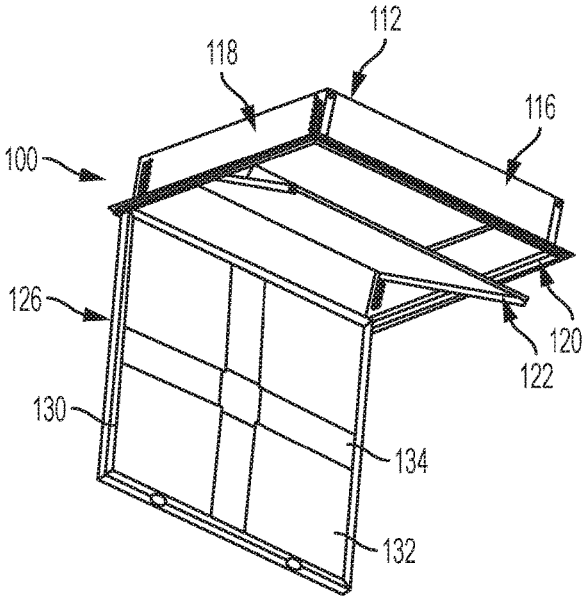
FIG. 6 is a bottom perspective view of the luminaire of FIG. 5 with the door assembly in an open position.

FIGS. 1-4 depict an exemplary embodiment of a luminaire 10 having a housing assembly 12 and one or more light emitting devices (not shown). The light emitting device can include one or more Light Emitting Diodes (LEDs), fluorescents, halogens, or other light emitters. The luminaire 10 has a 1×4 configuration—that is, it is 4 times longer in one dimension, length or width, than it is in the other. For example, a 1 foot by 4 foot luminaire.

In an exemplary embodiment the housing assembly 12 includes a first side wall 14, a second side wall 16, a first end wall 18, and a second end wall 20, a support for retaining the light emitting device, for example a mounting plate 22, a cover 24, and a door 26. The various components of the housing assembly 12 can be a single piece or formed from multiple pieces and connected together, for example through brackets, rivets, fasteners, or other mounting features. In an exemplary embodiment, the side walls 14, 16 and end walls 18, 20 are made from sheet metal, or other stiff, lightweight material.

As best shown in FIGS. 1-4, and according to various exemplary embodiments, each of the first and second side walls 14, 16 and first and second end walls 18, 20 includes a bottom flange 28A, 28B, 28C, 28D that combines when assembled to form a mounting flange 28 for the housing assembly 12. The mounting flange 28 can be used as a grip or grip-slot type mounting flange when placed in recessed ceiling.

In an exemplary embodiment, the door 26 includes a frame 30 surrounding an optical element 32, for example a lens or diffuser, which can be removably received by the door 26. The door 26 is moveably and removably connected to the remainder of the housing assembly 12, for example to the side walls 14, 16, so that different door types can be used with the housing assembly 12. The mounting plate 22 is removably and moveably connected to the first and second end walls 18, 20.

FIGS. 5-10 depict another exemplary embodiment of a luminaire 100 having a housing assembly 112 and one or more light emitting devices 102. The luminaire 100 is configured to have a 2×2 size. The housing assembly 112 includes first and second side walls, 114, 116, first and second end walls, 118, 120, a mounting plate 122, a cover 124. A door 126 having a frame 130 and an optical element 132. The door 126 can optionally include a cross member 134. The cross member 134 can separate the optical element 132 into four different segments or retain four separate optical elements 132.

Figure 7:
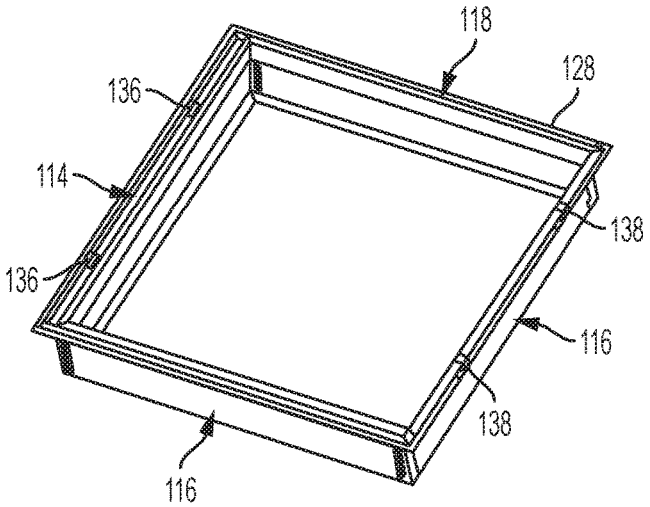
FIG. 7 is a bottom perspective view of the luminaire of FIG. 5 with the door removed.
Figure 8:
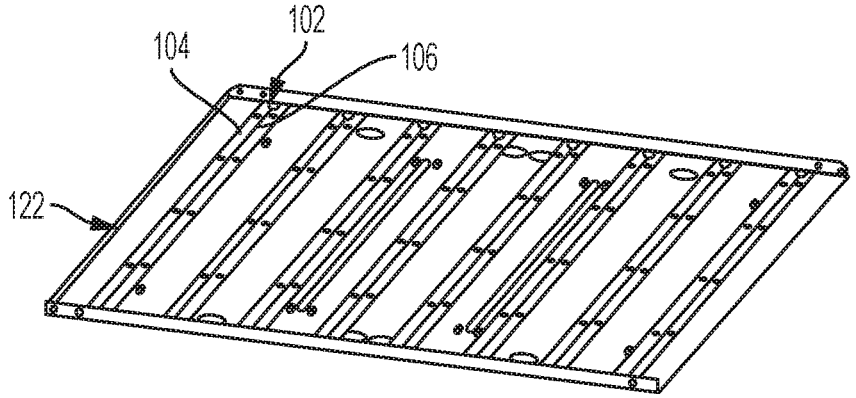
FIG. 8 is a bottom perspective view of an exemplary mounting plate.

In the exemplary embodiment shown in FIG. 7, the flange 128 of the first side wall 114 includes a pair of cutout portions 136 to act as a hinge to pivotably receive a portion of the door 126, for example a protrusion on the door 126. The second side wall 116, includes one or more latches 138 for retaining the door 126 in the closed position. The cutout portions 136 and latches 138 can be incorporated into any of the exemplary embodiments described herein.

Figure 9:
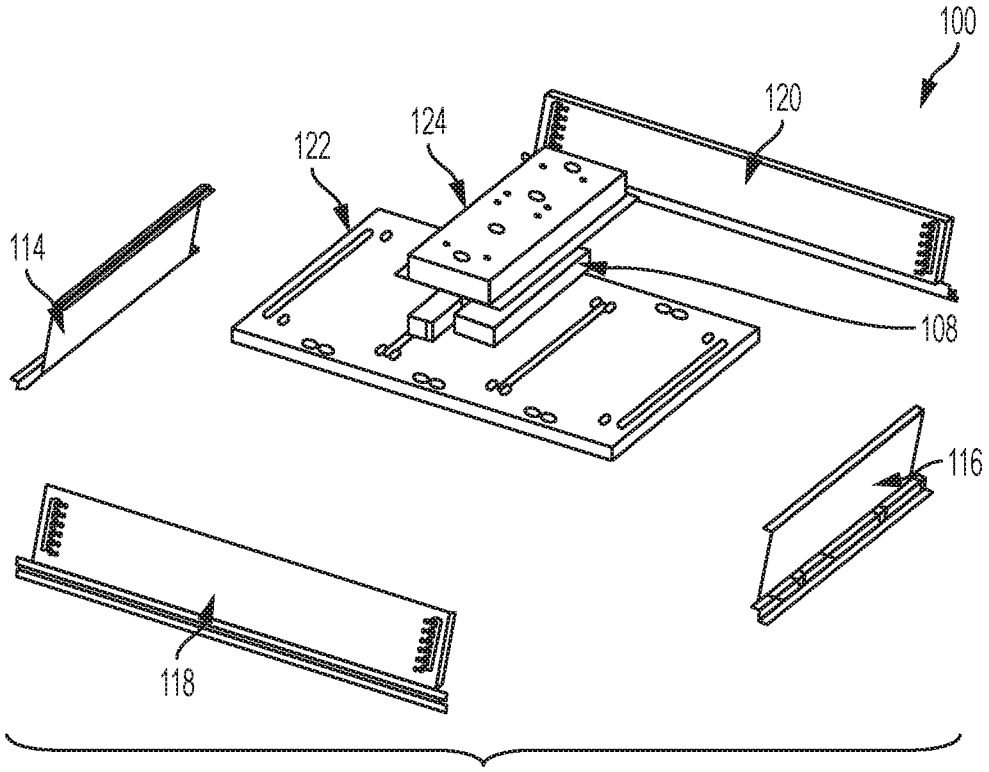
FIG. 9 is a top perspective, exploded view of the luminaire of FIG. 5.
Figure 10:
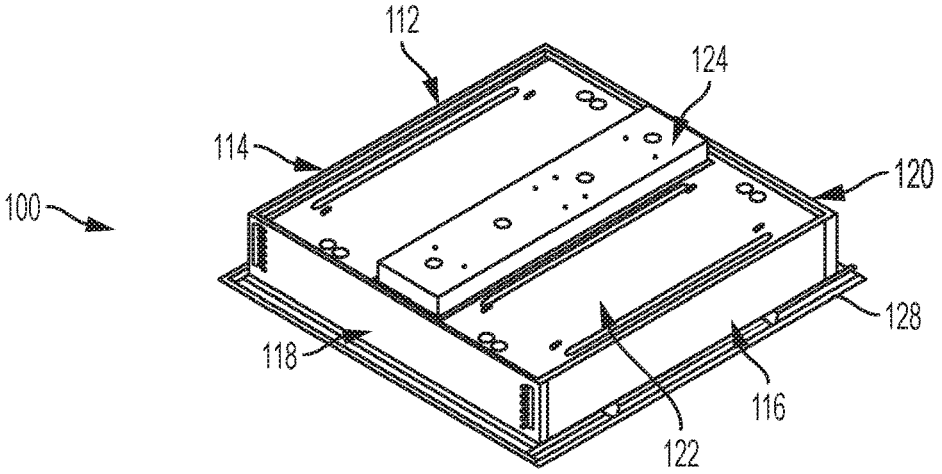
FIG. 10 is a top perspective view of the luminaire of FIG. 5.

As best shown in FIG. 9, the light emitting device 102 includes a substrate 104 containing a plurality of LED packages or modules 106. The substrates are connected to the mounting plate 122, for example through one or more fasteners. FIG. 9 shows 8 LED substrates 104, although different numbers can be used depending on the size and configuration of the luminaire 100. As best shown in the exemplary embodiment of FIG. 10, the top of the mounting plate 122 receives one or more power or control components 108, for example an LED ballasts or driver. The top and bottom surfaces of the mounting plate 122 can include a number of grooves and openings for connecting the light emitting devices 102 and power control component 108, and to provide pathways or conduits for connectors between the two. The light emitting device 102 can be incorporated into any of the exemplary embodiments described herein.

Figure 11:
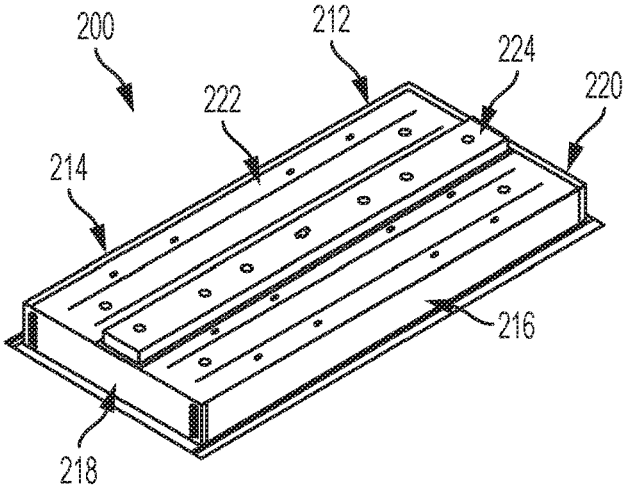
FIG. 11 is a top perspective view of another exemplary luminaire.
Figure 12:
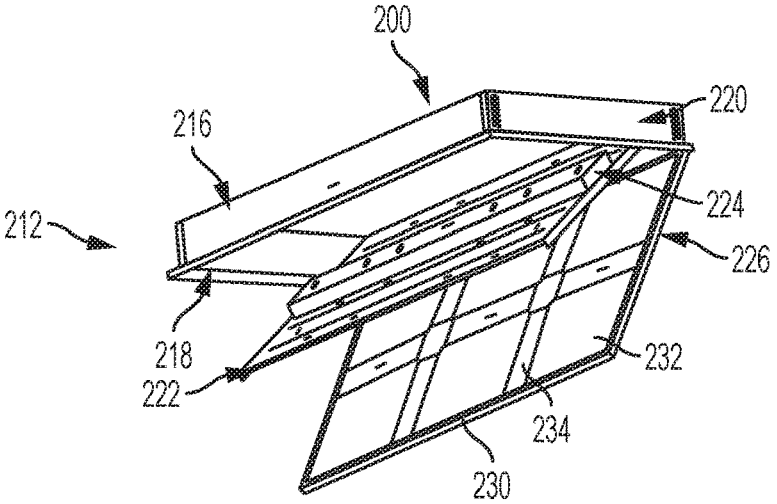
FIG. 12 is a bottom perspective view of the luminaire of FIG. 11 with the door assembly in an open position.

FIGS. 11 and 12 depict an exemplary embodiment of a luminaire 200 having a housing assembly 212 configured to have a 2×4 size. The housing assembly 212 includes first and second side walls 214, 216, first and second end walls 218, 220, a mounting plate 222, and a cover 224. A door 226 having a frame 230 and one or more optical elements 232 is connected to the housing 212. The door 226 can also include an optional cross member 234. The cross member 234 can separate the optical element 232 into six different segments or retain six separate optical elements 232.

Figure 13:
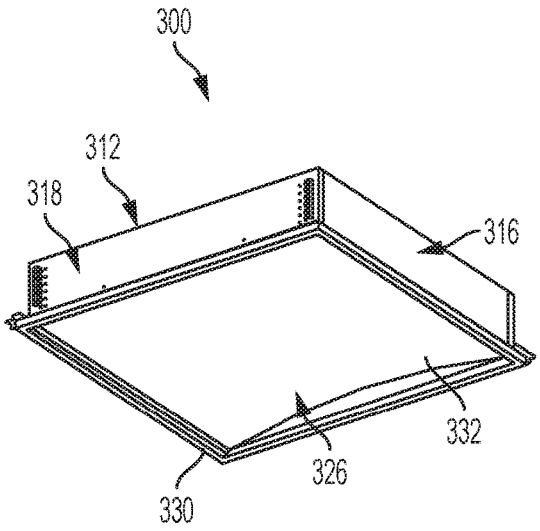
FIG. 13 is a bottom perspective view of another exemplary luminaire.
Figure 14:
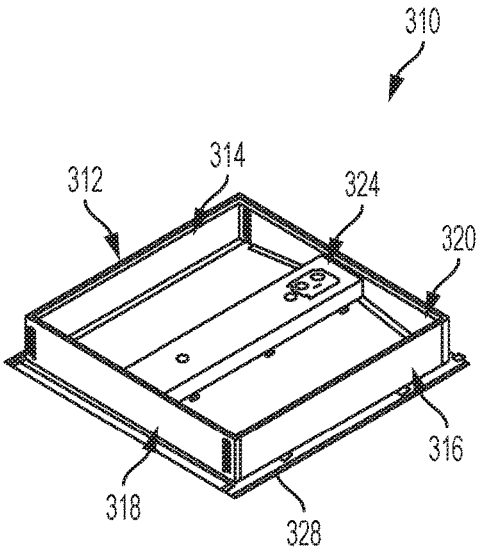
FIG. 14 is a top perspective view of the luminaire of FIG. 13.
Figure 15:
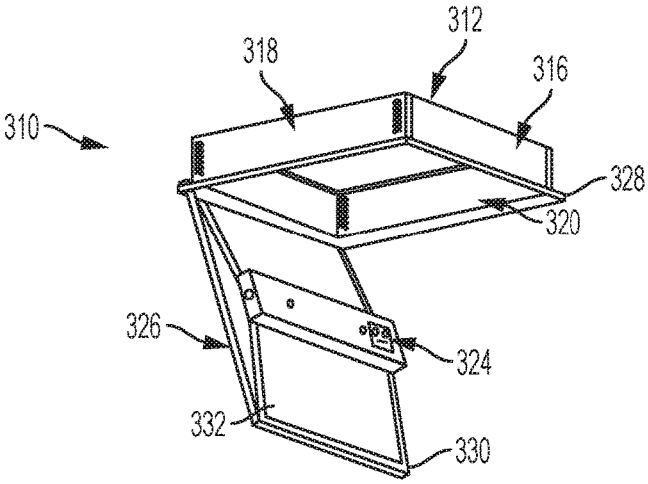
FIG. 15 is a bottom perspective view of the luminaire of FIG. 13 with the door assembly in an open position.

FIGS. 13-15 depict an exemplary embodiment of a luminaire 300 having a housing assembly 312 configured as an edge lighting device. The housing assembly 312 includes first and second side walls, 314, 316, first and second end walls, 318, 320, a cover 324, and a door 326 having a frame 33o and one or more optical elements 332. In this assembly, the mounting plate is removed and the light emitting device (not shown) and cover are positioned on, and connected to, the door 326. The exemplary optical element 332 shown curves toward the light emitting device.

Figure 16:
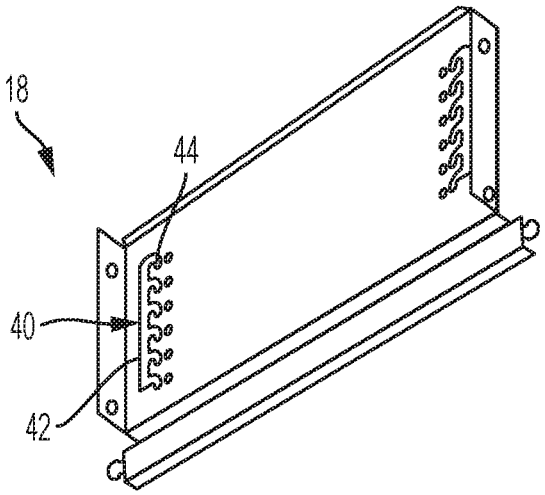
FIG. 16 is a top perspective view of an exemplary end wall.
Figure 17:
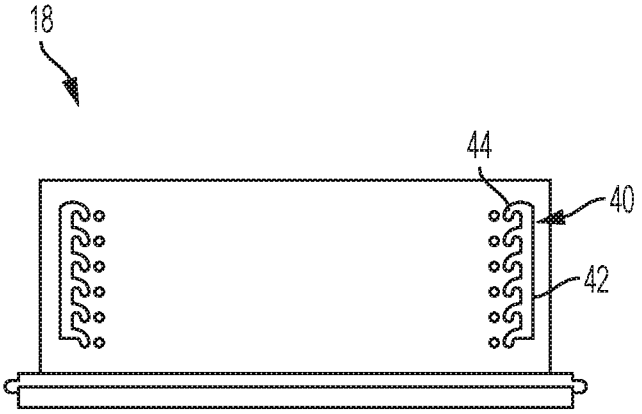
FIG. 17 is a front view of the end wall of FIG. 16.
Figure 18:
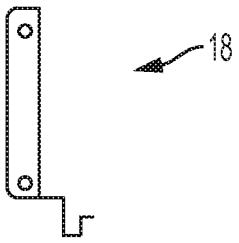
FIG. 18 is a left side view of the end wall of FIG. 16.
Figure 19:
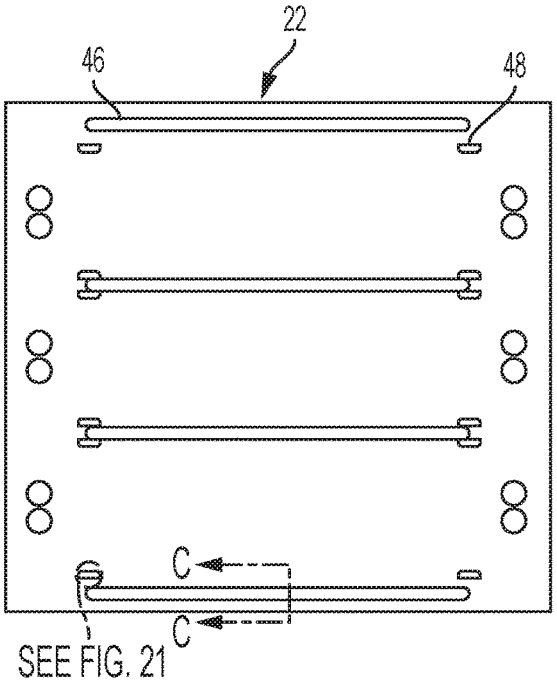
FIG. 19 is a top view of an exemplary mounting plate.
Figure 20:
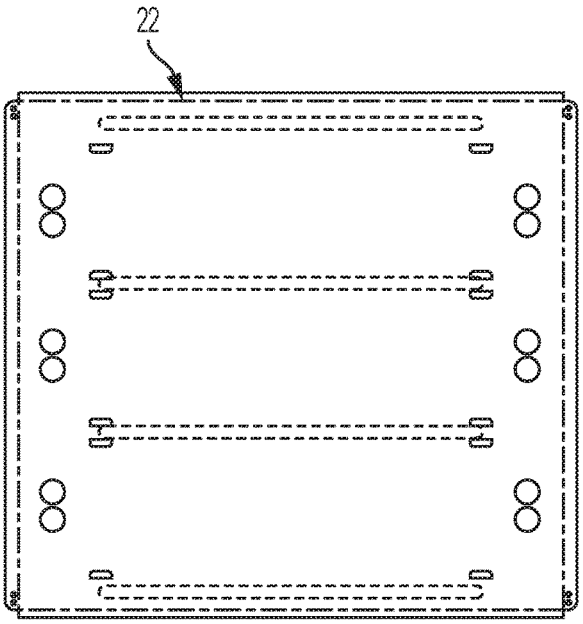
FIG. 20 is a bottom view of the mounting plate of FIG. 19.
Figure 21:
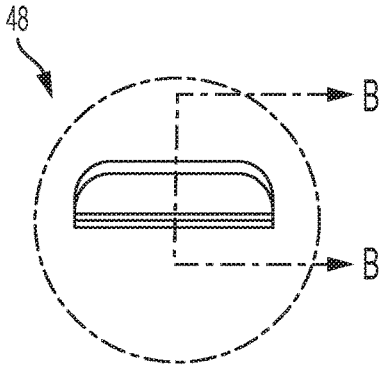
FIG. 21 is a magnified view of detail A of FIG. 19.
Figure 22:
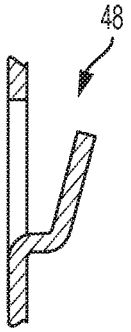
FIG. 22 is a sectional view of FIG. 21 taken along line B-B.
Figure 23:
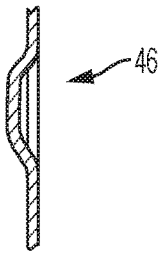
FIG. 23 is a sectional view of FIG. 19 taken along line C-C.

FIGS. 16-18, depict an exemplary end wall 18 that can be used with any of the exemplary embodiments described herein. The end wall 18 includes a set of ladder adjustment features 40, for example a first ladder adjustment feature and a second ladder adjustment feature. The ladder adjustment feature 40 includes a vertical slot 42 with a plurality of branching slots 44 extending therefrom. The branching slots 44 extend away from the vertical slot 42 and curve downward towards the flange 28. In various exemplary embodiments, the mounting plate 22 includes a plurality of posts or other protrusions extending from a first end and a second end to be removeably received in a respective ladder adjustment feature 40. Adjusting the position of the mounting plate 22 in the ladder adjustment features 40 adjusts the spacing of the light emitting device to the ceiling and to the optical component 32 in the door 26. By adjusting the distance to the optical component 32, the characteristics of the light emitted to a room can be modified. For example, the optical component 32 may contain a plurality of diffuser elements that disperse the light based on the position of the light source.

FIGS. 19-23, depict an exemplary mounting plate 22 having a bottom surface and a top surface. One or more light emitting devices are connected to the bottom surface of the mounting plate 22 and hardware associated with the light emitting devices, for example a driver or ballast, is positioned on top of the mounting plate 22. The mounting plate 22 can include various mounting features to connect hardware and apertures, including slots and openings, to provide a passage for electrically connecting a light emitting device to the hardware. FIGS. 19-22 depict a mounting plate 22 having one or more clips 48 to retain drivers and one or more slots 46 to provide a conduit for one or more conductors.

Figure 24:
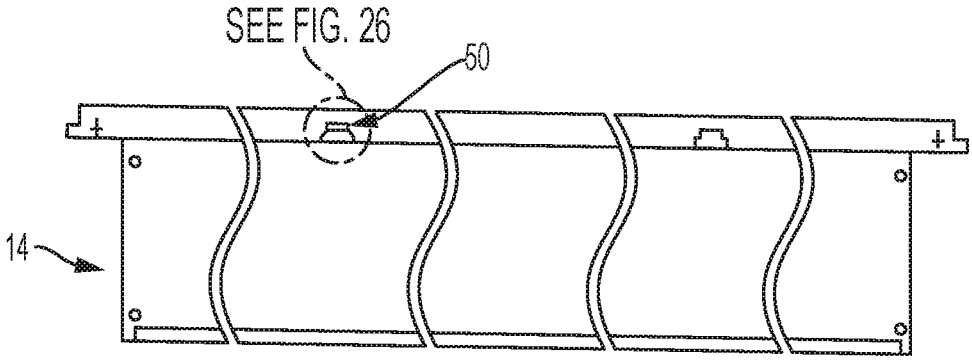
FIG. 24 is a left side view of an exemplary side wall.
Figure 25:
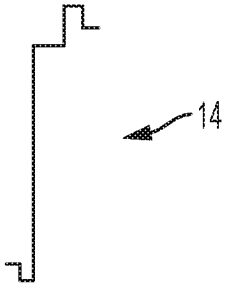
FIG. 25 is a front view of the side wall of FIG. 24.
Figure 26:
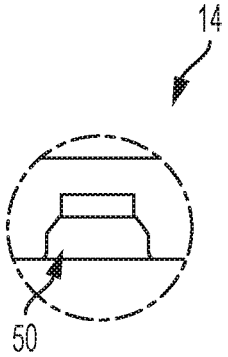
FIG. 26 is a magnified view of detail A of FIG. 24.
Figure 27:
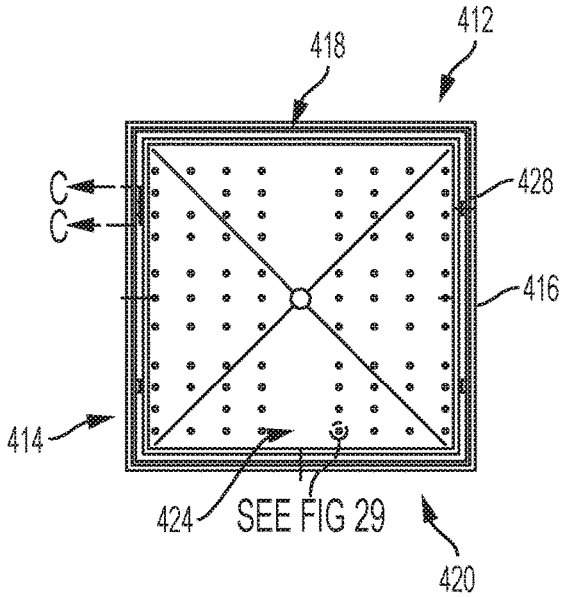
FIG. 27 is a bottom view of an exemplary housing assembly.
Figure 28:
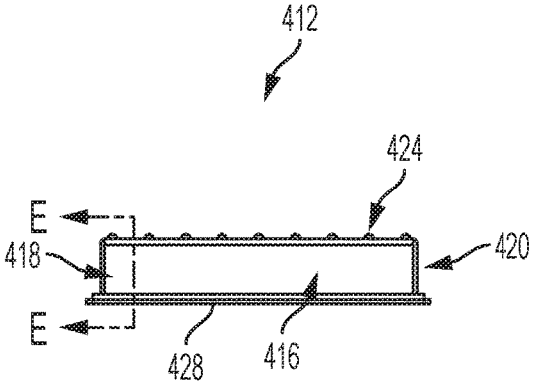
FIG. 28 is a right side view of the housing assembly of FIG. 27.
Figure 29:
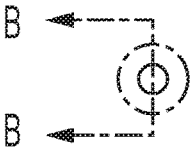
FIG. 29 is a magnified view of detail A of FIG. 27.
Figure 30:
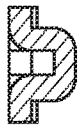
FIG. 30 is a sectional view of FIG. 29 taken along line B-B.
Figure 31:
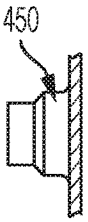
FIG. 31 is a sectional view of FIG. 27 taken along line C-C.
Figure 32:
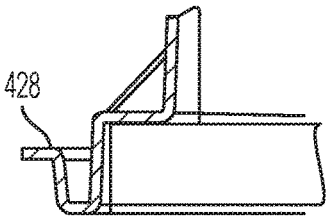
FIG. 32 is a sectional view of FIG. 28 taken along line E-E.
Figure 33:
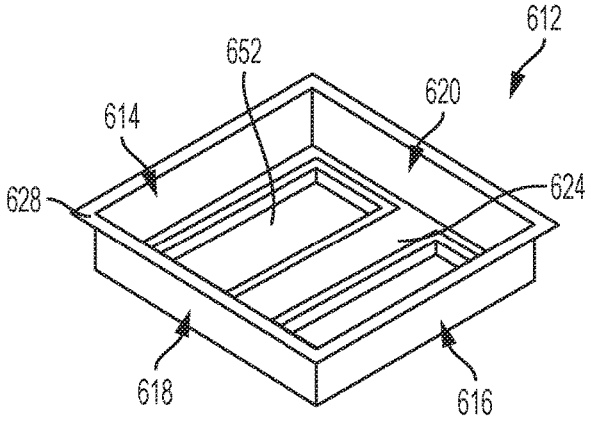
FIG. 33 is a bottom perspective view of an exemplary housing assembly.
Figure 34:
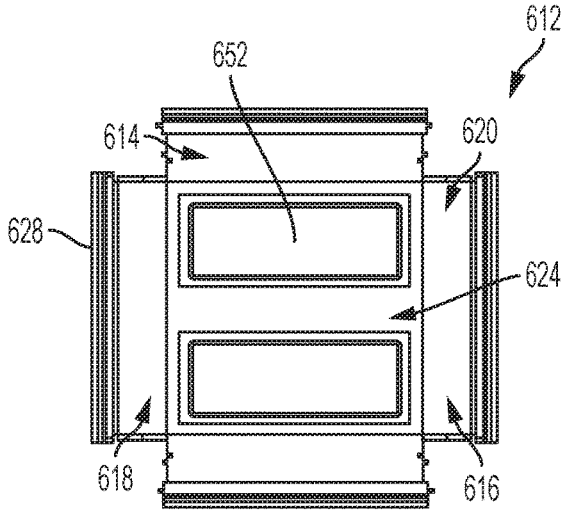
FIG. 34 is a bottom, unfolded view of the housing assembly of FIG. 33.
Figure 35:
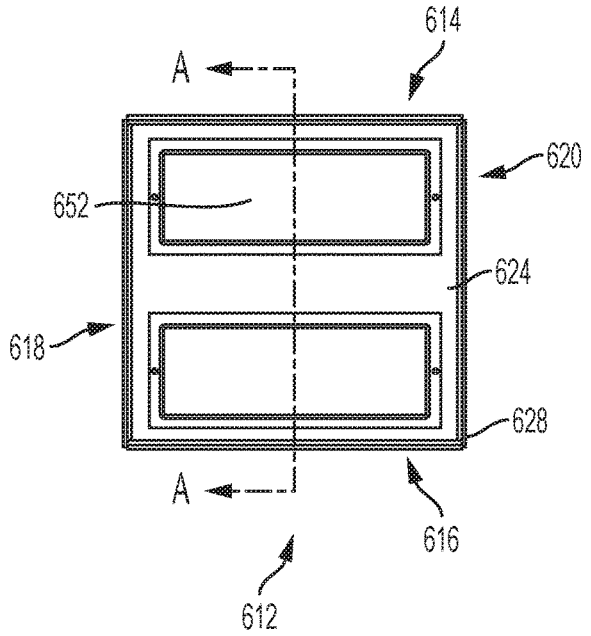
FIG. 35 is a bottom view of the housing assembly of FIG. 33.
Figure 36:
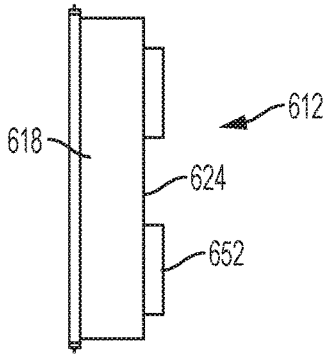
FIG. 36 is a sectional view of FIG. 35 taken along line A-A.

FIGS. 24-26 depict an exemplary sidewall 14. The sidewall 14 includes a cut out portion 50 that acts as a hinge to pivotally receive a portion of the door 26. As best shown in the exemplary embodiments of FIGS. 3, 6, 12, and 15, one side of the door 26, 126, 226, 326 can be pivoted with respect to the cutout portion 50 and the mounting plate 22 can be pivoted about the two ladder adjustment features 40 on opposite end walls 18, 20 to provide access from below the luminaire 10, without having to remove the entire light housing assembly 12. This can allow a user to install or replace components of the luminaire without removing the housing form the ceiling or removing ceiling components to gain access to the top of the luminaire.

The sidewalls 12, 14 can be formed at any length and the end walls 18, 20 may also be formed at any length. Different sizes of side walls 12, 14 and end walls 18, 20 can be connected together, providing a modular unit that can be used in different applications. For example, a set of end walls 18, 20 having a length of two feet can be used with sets of side walls 12, 14 having a length of two through six feet to form different length luminaires.

FIGS. 27-32 depict an exemplary embodiment of a single piece luminaire housing 412 that can be formed or molded as a single piece, unitary and/or monolithic structure. The housing assembly 412 includes first and second side walls 414, 416, first and second end walls 418, 420, a top cover 424, and a bottom flange 428. The first side wall includes one or more hinge cut outs 450 to pivotally receive a door assembly (not shown). The housing 412 can be formed in different sizes and shapes.

Figure 37:
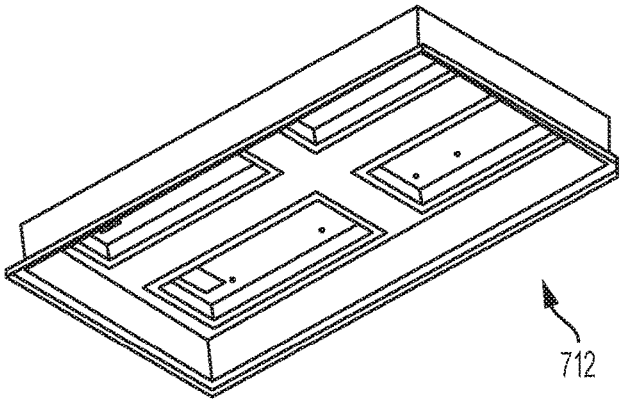
FIG. 37 is a bottom perspective view of an exemplary housing assembly.
Figure 38:
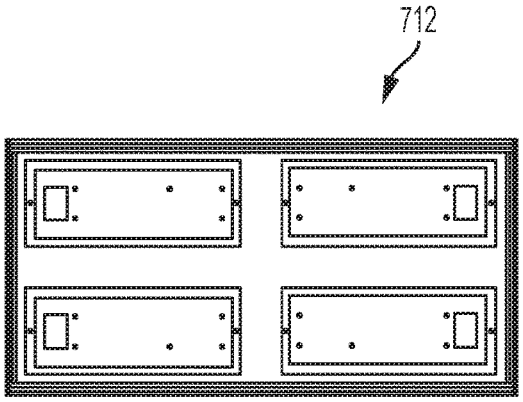
FIG. 38 is a bottom view of the housing assembly of FIG. 37.
Figure 39:
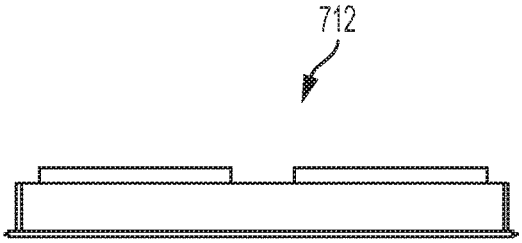
FIG. 39 is a front view of the housing assembly of FIG. 37.

FIGS. 33-36 depict an exemplary housing assembly 612 having first and second side walls 614, 616, first and second end walls 618, 620, a top cover 624, and a bottom flange 628. The cover 624 includes a pair of recesses 652 to receive one or more power or control components, for example an LED driver. One or more plates, or other structures or substrates, containing LEDs can be placed into the interior of the housing assembly 612 and connected to one or more control components positioned in the recess 652. FIGS. 37-39 depict a similar housing assembly 712 having a substantially rectangular configuration. The housings 612, 712 can be formed in different sizes and shapes.

The foregoing detailed description of the certain exemplary embodiments has been provided for the purpose of explaining the principles of the invention and its practical application, thereby enabling others skilled in the art to understand the invention for various embodiments and with various modifications as are suited to the particular use contemplated. This description is not necessarily intended to be exhaustive or to limit the invention to the exemplary embodiments disclosed. Any of the embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

As used in this application, the terms "front," "rear," "upper," "lower," "upwardly," "downwardly," and other orientational descriptors are intended to facilitate the description of the exemplary embodiments of the present invention, and are not intended to limit the structure of the exemplary embodiments of the present invention to any particular position or orientation. Terms of degree, such as "substantially" or "approximately" are understood by those of ordinary skill to refer to reasonable ranges outside of the given value, for example, general tolerances associated with manufacturing, assembly, and use of the described embodiments.

What is claimed:

1. A modular luminaire system comprising:

a first set of side walls having a first length;

a second set of side walls having a second length different than the first length;

a first set of end walls having a third length; and a second set of end walls having a fourth length different than the third length, wherein the first set of side walls is individually and selectively coupled to the first set of end walls and to the second set of end walls, and the second set of side walls is individually and selectively coupled to the first set of end walls and to the second set of end walls separately from the first set of side walls, and wherein one of the first and second sets of side walls connected to one of the first and second sets of end walls forms a wall assembly for a luminaire housing.

2. The modular luminaire system of claim 1, wherein the first and second sets of side walls are formed to have a length in the range of approximately 1 foot to approximately ten feet and the first and second sets of end walls are formed to have a length in the range of approximately 1 foot to approximately ten feet.

3. The modular luminaire system of claim 1, further comprising a support connected to the wall assembly and a lens connected to the wall assembly.

4. The modular luminaire system of claim 3, wherein the lens is connected to a door that is moveably connected to the wall assembly.

5. The modular luminaire system of claim 3, wherein the position of the support with respect to the wall assembly is adjustable.

6. The modular luminaire system of claim 3, wherein the end walls includes a height adjustment feature and the support is connected to the height adjustment feature.

7. The modular luminaire system of claim 6, wherein the height adjustment feature includes a ladder adjustment feature having a vertical slot and a plurality of branching slots.

8. The modular luminaire system of claim 1, further comprising a door having a lens and connected to the wall assembly and a support connected to the door.

9. A luminaire housing comprising:

a wall assembly having a first side wall, a second side wall, a first end wall connected to the first and second side walls, and a second end wall connected to the first and second side walls;

a mounting plate connected to the wall assembly so that the position of the mounting plate can be adjusted with respect to the wall assembly;

a door having a lens connected to the wall assembly and moveable between an open position and a closed position; and one or more light emitters connected to the mounting plate.

10. The luminaire housing of claim 9, wherein the mounting plate is pivotally connected to the wall assembly.

11. The luminaire housing of claim 9, wherein the first and second end walls includes a height adjustment feature and the mounting plate is connected to the height adjustment feature.

12. The luminaire housing of claim 9, wherein the height adjustment feature includes a ladder adjustment feature having a vertical slot and a plurality of branching slots.

13. The luminaire housing of claim 12, wherein the branching slots include a downward curve.

14. The luminaire housing of claim 9, wherein the door is pivotally connected to the wall assembly.

15. The luminaire housing of claim 9, further comprising a control component connected to the mounting plate and operably connected to the one or more light emitters.

16. A luminaire housing comprising:

a first side wall and a second sidewall connected to a first end wall and a second endwall;

a top cover connected to the first and second sidewalls and the first and second endwalls; and a recess positioned in the top cover to receive a control component for a light emitter.

17. The luminaire housing of claim 16, wherein the recess is sized to receive a driver.

18. The luminaire housing of claim 16, wherein the first and second sidewalls, the first and second endwalls, and the recess are integrally formed.

19. The luminaire housing of claim 16, further comprising a second recess positioned in the top cover to receive a control component for a light emitter.

* * * * *